US005813152A

United States Patent [19]

Weight

[11] Patent Number: 5,813,152

[45] Date of Patent: Sep. 29, 1998

[54] SNOWBLOWER CHISEL ATTACHMENT

[76] Inventor: Arlan Weight, 1937 Jackson Ave., Bismarck, N. Dak. 58501

[21] Appl. No.: 865,247

[22] Filed: May 29, 1997

[51] Int. Cl.[6] ..... E02F 3/36

[52] U.S. Cl. ..... 37/447; 37/254; 37/253; 37/249

[58] Field of Search ..... 37/241, 242, 243, 37/244, 247, 248, 249, 253, 254, 257, 266, 270, 447, 446, 465, 903; 414/722; 299/26

[56] References Cited

U.S. PATENT DOCUMENTS

| | | | |
|---|---|---|---|
| 1,730,817 | 10/1929 | Gyllenkrook | 37/271 |
| 2,198,237 | 4/1940 | Voorderman | 37/258 |
| 2,610,414 | 9/1952 | Vanick | 37/251 |
| 2,779,112 | 1/1957 | Garland | 37/248 |
| 3,238,646 | 3/1966 | Oldenburg | 37/447 |
| 3,340,626 | 9/1967 | Konick | 37/243 |
| 3,475,841 | 11/1969 | Delfino et al. | 37/447 |
| 3,490,057 | 1/1970 | Kahlbacher | 37/271 X |
| 3,576,097 | 4/1971 | Speiser | 37/232 X |
| 3,795,070 | 3/1974 | Bronson et al. | 37/405 |
| 4,833,800 | 5/1989 | Ting | 37/243 |

*Primary Examiner*—Tamara L. Graysay
*Assistant Examiner*—Thomas A. Beach
*Attorney, Agent, or Firm*—David A. Lingbeck

[57] ABSTRACT

A snowblower chisel attachment includes an oscillatable elongate blade member oscillatably disposed at a bottom front of a snowblower housing; a pair of support arms pivotally suspended from the sidewalls of the housing and being secured to the oscillatable elongate blade member; a pair of stub shafts journaled through the sidewalls of the housing; a pair of three lobed cams mounted to the stub shafts for contacting and urging the support arms and intervally urging the oscillatable elongate blade member forwardly relative to the housing; a plurality of sprockets for rotating the stub shafts and the cams; a pair of biased elements for urging the oscillatable elongate blade member rearwardly toward the housing; and skid members for vertically positioning the oscillatable elongate blade member relative to the surface. When the snowblower is turned on and the auger engaged, the sprockets rotate the stub shafts which rotate the cams which intervally urge the oscillatable elongate blade member forwardly to cut and chisel generally solidified snow lying in its path. Between the interval contacts by the lobes on the cam, biased elements urge the oscillatable elongate blade member rearwarly toward the housing and effect the oscillation of the oscillatable elongate blade member in combination with the cams.

10 Claims, 4 Drawing Sheets

SNOWBLOWER CHISEL ATTACHMENT

BACKGROUND OF THE INVENTION

The present invention relates to a snowblower chisel attachment for breaking up and chopping generally solidified snow formed upon driveways and sidewalks, in particular, to make it easier for a snowblower to effectively remove such snow.

Snow having fallen on a ground surface will begin to form a crust or will become hardened within a period of time because temperatures below the freezing point will convert any liquid particles in the snow to a solid. Such snow if not removed quickly after having fallen on a ground surface poses a problem to a person trying to remove the snow. Conventional snowblowers have augers which are designed to pick up and move loose snow but don't have any means to chop snow which has already hardened. The prior art doesn't describe nor suggest means which can be attached to a snowblower which allows the user break up and chop snow which wouldn't otherwise be removed by the snowblower.

One known prior art is a SNOW PUSHER WITH ADJUSTABLE HANDLE, U.S. Pat. No. 4,597,204, invented by Donald J. Heiden and issuded on Jul. 1, 1986, and which comprises a rigid snow diverting member having a rectangular plate, an elongated blade, a push handle extending in an upwardly inclined manner from the plate, and means for connecting the handle to the plate. This invention doesn't suggest an invention for breaking up and chopping snow in conjunction with a snowblower.

Another known prior art is a DAPTABLE SNOW SCRAPER, U.S. Pat. No. 5,410,824, invented by Donald A. Pederson and issued on May 2, 1995, and which comprises a snowblower, a frame mounted on the housing of the snowblower, the frame including laterally adjustable means, a plate mounted on the frame, a plow secured to the plate and having a blade for scraping material from a surface, and means for coupling the frame to the housing. As with the first described prior art, this invention lacks the capablility of effectively breaking up and chopping hardened or crusted snow.

None of the prior art indicated describes nor suggests attaching a chiseling attachment directly to the snowblower to allow the user to effectively use one's snowblower to remove generally solidified snow.

SUMMARY OF THE INVENTION

The present invention comprises an oscillatable elongate blade member having a longitudinal cutting edge, a pair of support arms attached to the ends of the oscillatable elongate blade member and being pivotally attached to the snowblower housing, a pair of cams mounted upon a pair of stub shaft members which are journaled through the sidewalls of the snowblower housing, drive means for actuating the cams which actuate the support arms for rapidly oscillating the oscillatable elongate blade member forwardly and rearwardly to chop and break up generally solidified snow, a first elongate blade member fixedly mounted to the front bottom of the snowblower housing for facilitating clean up, and a pair of height adjustable skid means adjustably mounted upon the sidewalls of the housing of the snowblower for adjustably positioning the height of the elongate blade members relative to the ground surface upon which the snowblower is being operated.

One objective of the present invention is to provide a snowblower chisel attachment which makes it easier for the snowblower to pick up and throw the snow since, instead of the snow being hard and unmanageable, the snow is powdery and chopped for easy throwing by the snowblower.

Another objective of the present invention is to provide a snowblower chisel attachment which essentially allows the snowblower to remain on the surface rather than riding up on the generally solidified snow, thus making it easier for the user to clear the snow off the surface.

Further, another objective of the present invention is to provide a snowblower chisel attachment which allows the user to fully make use of the snowblower, a problem not readily solved with the prior art technology. Yet, another objective of the present invention is to provide a snowblower chisel attachment which substantially eliminates the user having to break up or chop the generally solidified snow manually or by hand before being able to successfully use the snowblower to clear the surface.

Further objectives and advantages of the present invention will become apparent as the description proceeds and when taken in conjunction with the accompanying drawings wherein:

DETAILED DESCRIPTION OF THE INVENTION

Figure 1:
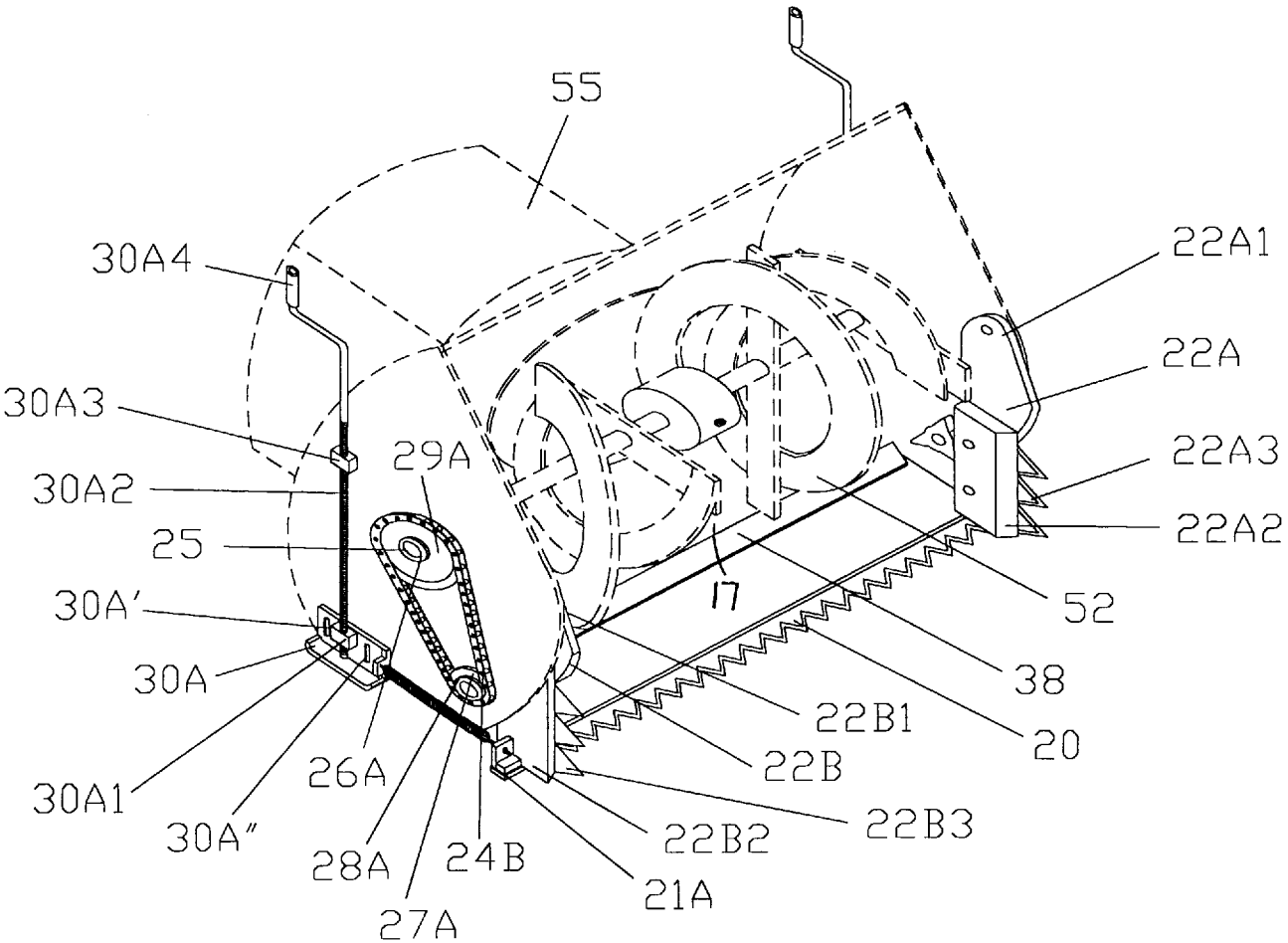
FIG. 1 is a right front perspective view of the snowblower chisel attachment.

Referring to the drawings in FIGS. 1–4, in particular, the snowblower chisel attachment, in combination with a snowblower 55, comprises a first elongate blade member 38 which extends along the width of a snowblower housing 15 which includes a pair of sidewalls 16A–B, a bottom portion or floor 17, a top portion or hood 18, and a back portion with an opening therethrough leading to a chute through which snow is thrown by a plurality of snow throwing members movably disposed in the opening and which is fed snow by an auger member 52 which is rotatably mounted to an auger shaft 25 inside the housing 15 and which is driven by a conventional motor (not shown) which is energized by a conventional battery and conventional control mechanism, the first elongate blade member 38 having a longitudinal cutting leading edge and being securely fastened with conventional means to the front edge of the bottom portion 17 of the housing 15 to facilitate cleanup of any snow on the ground surface as the snowblower 55 is being operatively used.

Further, the snowblower chisel attachment comprises an oscillatable elongate blade member 20 having a longitudinal leading cutting edge and having its length essentially disposed perpendicular to the direction of movement of the snowblower 55 and further being essentially disposed parallel and horizontal to a ground surface and parallel to the front of the bottom portion 17 of the housing 15. The oscillatable elongate blade member 20 is disposed at the open front of the housing 15 and spaced forward of and generally aligned with the bottom portion 17 of the housing and has ends which are attached with conventional means to the bottom ends 22A2,22B2 of a pair of support arms 22A–B which further have top portions 22A1,22B1 which are pivotally attached with bolts to the inside of the housing 15 and on the inner sides and near the top of the sidewalls 16A–B, the bolts being extended through the sidewalls 16A–B and through holes in the top portions 22A1,22B1 of the support arms 22A,22B. Each support arm 22A–B has three adjacent wedge-shaped blade members 22A3,22B3 having rear portions securely extended, imbeded, or molded in the respective support arm 22A,22B on the front and along the bottom portion 22A2,22B2 thereof and further having wedge-shaped blade edges facing or extending forward of the respective support arm 22A,22B, the three wedge-shaped blades 22A3,22B3 being vertically aligned to one another and being used to facilitate the breaking up of generally solidified snow formed in chunks or masses of which cannot be fed effectively through the auger 52 in the housing 15 unless they are broken up further into a general powder form. As an alternate embodiment, the support arms 22A,22B are adjustable vertically with respect to the housing 15 by means of a pair of adjustable means each of which comprises a threaded support arm support 23A3,23B3 fixedly attached with conventional means to a top portion of the respective support arm 22A,22B and being extended through and vertically slidable with respect to a respective side wall 16A,16B of the housing 15. A pair of adjustable members each having a threaded shaft 23A,23B and a handle 23A1,23B1 are threaded through the support arm supports 23A3,23B3 and are threaded through a pair of adjustable member supports 23A2,23B2 each of which is fixedly mounted with conventional means on the exterior of a respective side wall 16A,16B of the housing 15. By either threading the threaded shafts 23A,23B in or out of the support arm supports 23A3,23B3, the user can raise and lower the support arms 22A,22B which in turn raises and lowers the oscillatable elongate blade member 20 relative to the housing 15 and to the ground or surface so that the user can adjust the height of the oscillatable elongate blade member 20 depending upon the conditions the user is confronted with.

When the snowblower 55 is energized, the support arms 22A,22B are pivoted about their top portions 22A1,22B1 by a pair of three-lobed cams 35,36 each of which is securely mounted about a respective stub shaft member 28B which is journaled through a lower portion of a respective sidewall 16A,16B of the housing 15, the cams 35,36 and the stub shaft members 28B being a part of a drive means. The cams 35,36 are mounted inside the housing 15 and are secured by means of flange bearings (not shown) which are at one end of the stub shaft members 28A–B with the cams 35,36 being between the inner side of the sidewalls 16A,16B and the flange bearings. The cams 35,36 are essentially polygon shaped having three or more sides with the lobes 35A1–A3, 36A1–A3 on each cam 35,36 being rounded and being generally equally spaced from one another.

Figure 2:
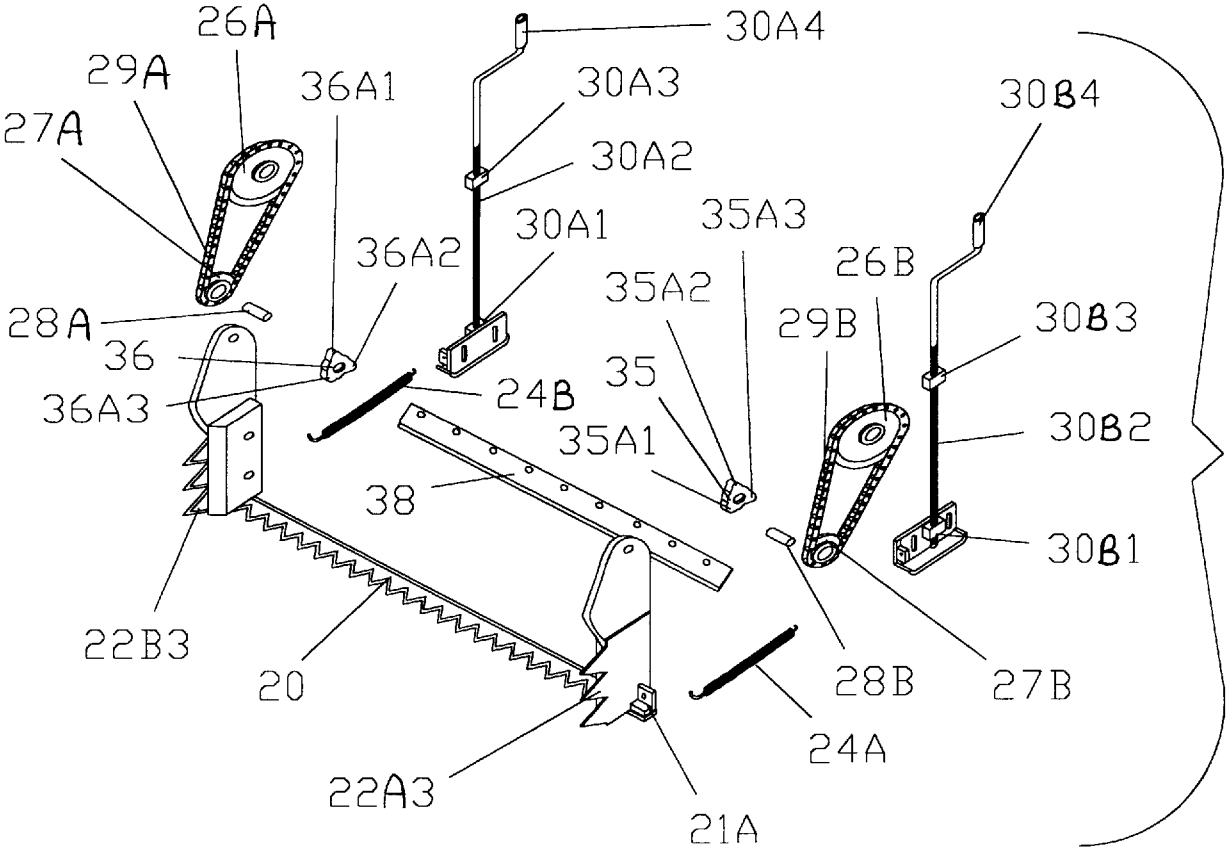
FIG. 2 is a left front exploded perspective view of the snowblower chisel attachment.
Figure 3:
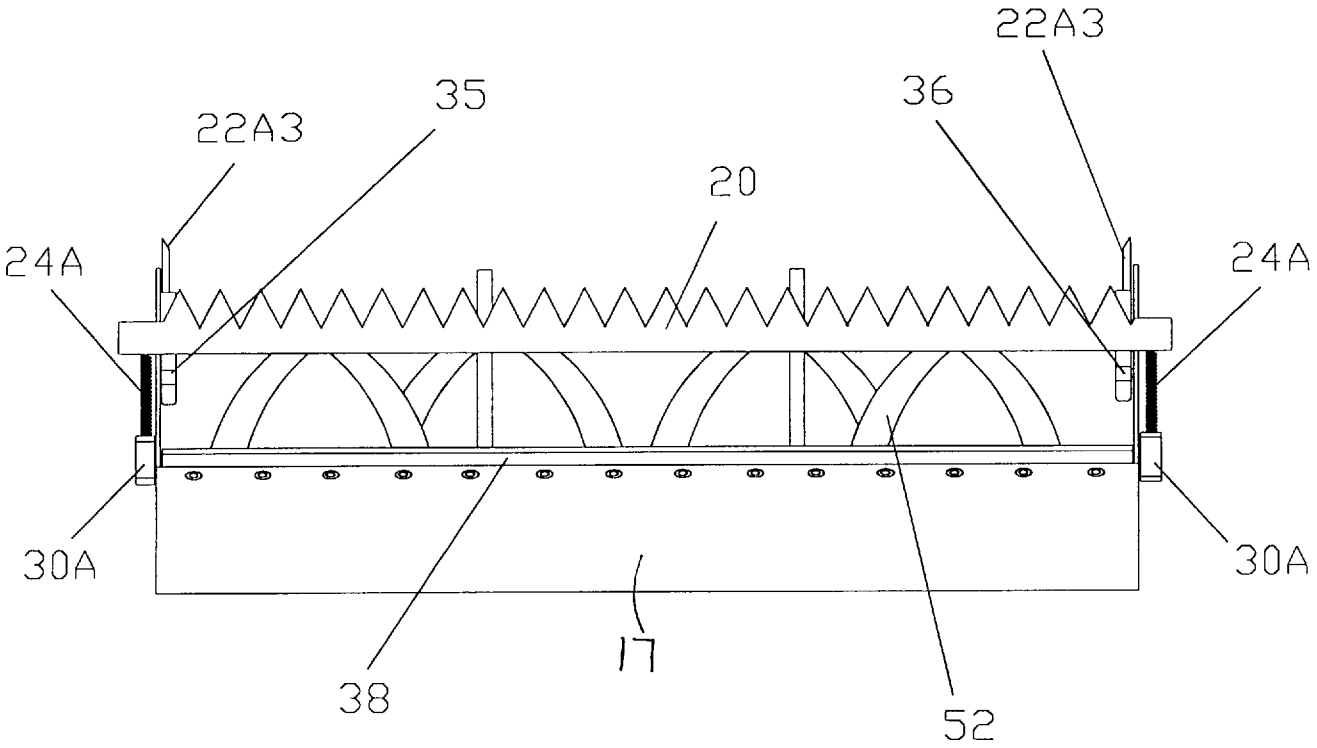
FIG. 3 is a bottom plan view of the snowblower chisel attachment.
Figure 4:
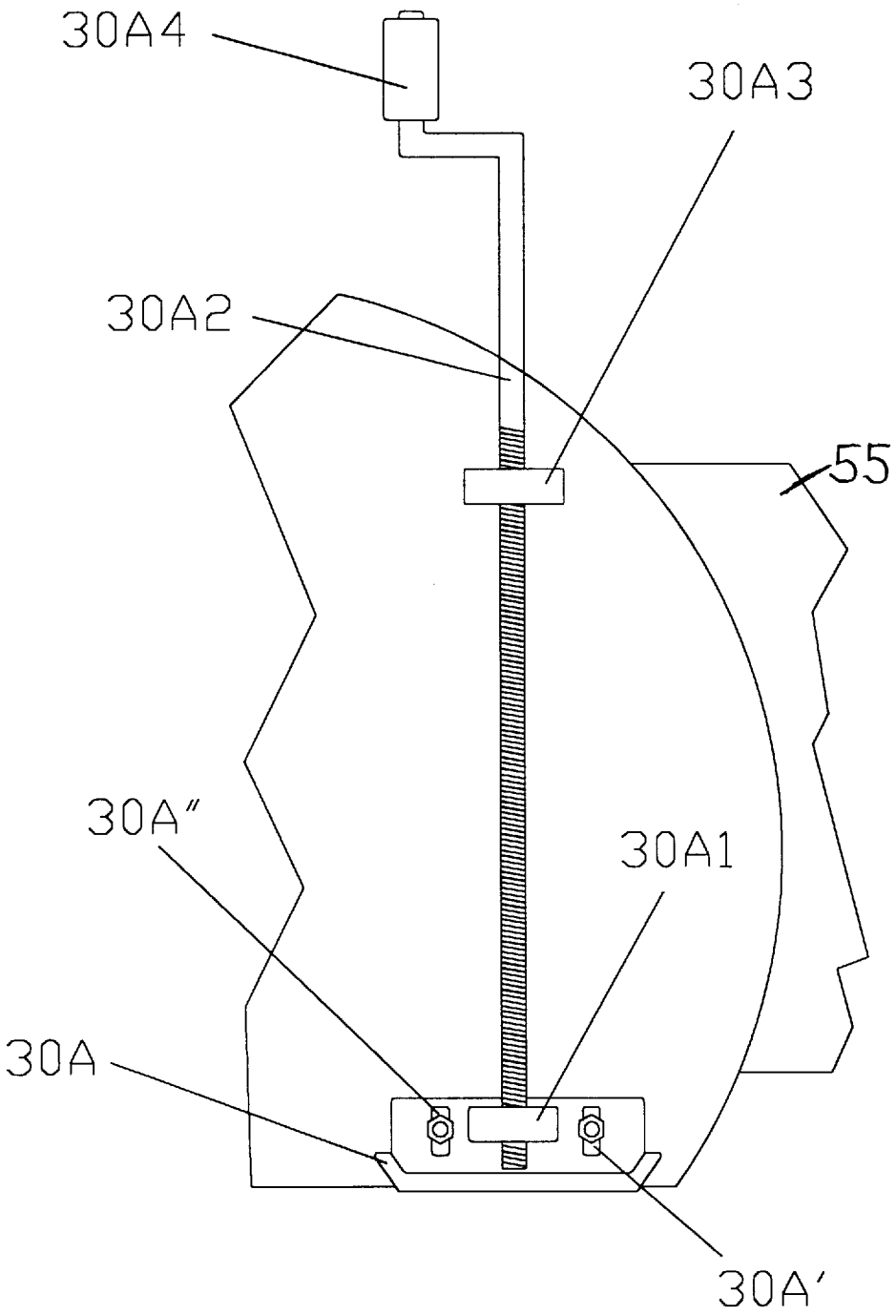
FIG. 4 is a detailed side elevational view of one of the height adjustable runners attached to the snowblower housing.

As shown in FIGS. 1–2, the cams 35,36 are actuated by the rest of the drive means which comprises a pair of first sprockets 27A–B, one of which is securely mounted with conventional means to an end of one of the stub shaft members 28A–B extending outside of the housing 15 and the other of which is securely mounted also with conventional means to an end of the other stub shaft member 28A–B extending outside of the housing 15, and further comprises a pair of second sprockets 26A–B, one of which is securely mounted with conventional means to one end of the auger shaft 25 extending outside of the housing 15 and the other of which is securely mounted with conventional means to the other end of the auger shaft 25 also extending outside of the housing 15.

As shown in FIGS. 1–2, a pair of endless chains 29A–B are carried about the pairs of first 27A–B and second sprockets 26A–B with the two second sprockets 26A–B having circumferences approximately twice that of the two first sprockets 27A–B such that for every revolution by the second sprockets 26A–B, approximately two revolutions are made by the first sprockets 27A–B. An auger shaft 52 of a conventional snowblower 55 rotates at approximately 180 rpms. Since the two second sprockets 26A–B are mounted to the auger shaft 52, the second sprockets 26A–B also rotate at approximately 180 rpms with the two first sprockets 27A–B rotating at approximately 360 rpms. As the first sprockets 27A–B rotate, the cams 35,36 also rotate, with the lobes 35A1–A3,36A1–A3 intervally, independently and momentarily contacting, engaging and urging the bottom portions 22A2,22B2 of the support arms 22A–B pivotally forward relative to the front of the housing 15 and further moving the oscillatable elongate blade member 20 forwardly from three quarters of an inch up to one inch. During the interval in which none of the lobes 35A1–A3,36A1–A3 on the cam 35,36 engages the support arms 22A–B, a pair of biased elements 24A–B such as tension or compression spring members biasedly urge the bottom portions 22A2, 22B2 of the support arms 22A,22B rearwardly relative to the housing 15, the spring members 24A–B each having one end connected to keepers 21A,21B which are secured to the ends of the oscillatable elongate blade member 20 and further having another ends fastened to brackets 30A–B mounted to the outerside of the housing 15 with bolts. With the oscillatable elongate blade member 20 securely attached to the bottom ends of the support arms 22A,22B, the oscillatable elongate blade member 20 will oscillate forwardly and rearwardly with the support arms 22A,22B. In the alternative, the drive means could also include at least one conventional motor (not shown) having a conventional shaft (not shown) connected to the stub shaft members 28A–B.

When in use, the oscillatable elongate blade member 20 should be at approximately one eighth of an inch above the ground surface. A pair of skid means are mounted to the sidewalls 16A–B of the housing 15 and are used to set and maintain the height of the elongate blade members 20,38 relative to the ground surface. The pair of skid means comprises a pair of brackets 30A–B each of which includes a pair of slots 30A',30A" extending through the wall of the brackets 30A–B and being laterally aligned with one another, and a planar guide member 30A1 fixedly attached or welded on its longitudinal edge to the wall of the bracket 30A–B and having a vertical hole extending therethrough and further includes an elongate skid member being generally flat except for the ends which are turned upward relative to the ground surface and having a bottom side for moving upon the ground surface. Each of the brackets 30A–B are adjustably fastened with bolts to the outerside and near the bottom of a respective sidewall 16A–B and near the back of the housing 15 with the bolts extending through the slots. Further, the skid means comprises a pair of threaded grommets 30A3–B3 each of which is fastened with conventional means to the outerside and near the top of a respective sidewall 16A–B. A pair of screw-type handle members 30A4–B4 each of which has an elongate member 30A2–B2 and a threaded portion on the elongate member 30A2–B2 are threaded through the grommets 30A3–B3 and have bottom portions which extend through the vertical holes in the guide members 30A1–B1 and have bottoms which are fixedly attached or welded on the tops of the skid members.

The user can adjust the height of the elongate blade members 20,38 above the ground surface by threading the screw-type handle members 30A4–B4 either downwardly or upwardly through the grommets 30A3–B3 relative to the ground surface which raises or lowers the skid members relative to the housing 15 and which raises and lowers the housing 15 and the elongate blade members 20,38 relative to the ground surface.

In operation, the user can adjust the height of the elongate blade members 20,38 relative to the ground surface by adjusting the skid members. The user does this by threading the screw-type handle members 30A4–B4 either downwardly or upwardly. After having done that, the user actuates the oscillating of the oscillatable elongate blade member 20 for the breaking up and chopping essentially solidified snow by energizing the snowblower 55 which actuates the rotation of the auger shaft 25. As previously described, the auger shaft 25 of a conventional snowblower 55 rotates at approximately 180 rpms. As the auger shaft 25 rotates, the pair of second sprockets 26A–B also rotates at that speed and actuates rotation of the pair of first sprockets 27A–B which are mounted to the stub shaft members 28A–B and which rotates at approximately 360 rpms and actuates the rotation of the cams 35,36 of which each lobe intervally, independently, and momentarily engages and urges the support arms 22A–B forwardly relative to the front of the housing 15. As the bottom portions 22A2,22B2 of the support arms 22A–B are pivoted forwardly, the oscillatable elongate blade member 20 is also moved forwardly toward and into any snow in front of the housing 15. Upon each lobe intervally disengaging the support arms 22A–B, the spring members 24A–B urge the support arms 22A–B and the oscillatable elongate blade member 20 rearwardly toward the housing 15. In combination, the lobes 35A1–A3, 36A1–A3 and the spring members 24A–B effectively causes the oscillatable elongate blade 20 member to oscillate back and forth at approximately 1060 oscillation chops per minute. The oscillatable elongate blade member 20 essentially undercuts and chops the snow as the snowblower 55 is moved over the ground surface to facilitate the removing of the snow by the snowblower 55. Without this chiseling attachment, the snowblower 55 would more than likely ride up over the generally solid snow rather than throwing the snow. This chiseling attachment allows the user to better make use of one's snowblower.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A snowblower chisel attachment in combination with a snowblower having a housing which includes a pair of sidewalls, a top portion, a bottom portion, a back portion having an opening therethrough and an auger mounted to an auger shaft which is rotatable disposed inside the housing and which has ends journaled through said pair of sidewalls comprising:

an oscillatable elongate blade member having a leading cutting edge for cutting into snow before the snowblower housing as said oscillatable elongate blade member oscillates forwardly and rearwardly relative to the housing;

a pair of support arms each securely attached to said oscillatable elongate blade member, said pair of support arms being pivotal with respect to said sidewalls, said pair of support arms each having a front and wedge-shaped blade members secured along said front for cutting snow as said support arms pivot forwardly and rearwardly relative to the housing;

a drive means for actuating oscillating movement of said oscillatable elongate blade member; and skid means for regulating disposition of said oscillatable elongate.

2. A snowblower chisel attachment as described in claim 1, wherein said wedge-shaped blade members on a respective one of said pair of support arms are essentially vertically aligned on edge with one another.

3. A snowblower chisel attachment as described in claim 2, wherein said wedge-shaped blade members are adjacently aligned along bottom portions of said pair of support arms.

4. A snowblower chisel attachment in combination with a snowblower having a housing which includes a pair of sidewalls, a top portion, a bottom portion, a back portion having an opening therethrough and an auger mounted to an auger shaft which is rotatable disposed inside the housing and which has ends journaled through said pair of sidewalls comprising:

an oscillatable elongate blade member having a leading cutting edge for cutting into snow before the snowblower housing as said oscillatable elongate blade member oscillates forwardly and rearwardly relative to the housing;

a pair of support arms each securely attached to said oscillatable elongate blade member, said pair of support arms being pivotal with respect to said sidewalls, said support arms being adjustable vertically with respect to said housing to raise and lower said oscillatable elongate blade member;

a drive means for actuating oscillating movement of said oscillatable elongate blade member; and skid means for regulating disposition of said oscillatable elongate.

5. A snowblower chisel attachment as described in claim 4, further includes means for vertically adjusting said support arms which comprises a pair of support arm supports attached to said support arms, a pair of threaded shafts to which said support arm supports are mounted, and a pair of adjustable member supports securely mounted to said housing and supporting and threadingly receiving said threaded shafts.

6. A snowblower chisel attachment in combination with a snowblower having a housing which includes a pair of sidewalls, a top portion, a bottom portion, a back portion having an opening therethrough and an auger mounted to an auger shaft which is rotatable disposed inside the housing and which has ends journaled through said pair of sidewalls comprising:

an oscillatable elongate blade member;

a pair of support arms each securely attached to said oscillatable elongate blade member, said pair of support arms being pivotal with respect to said sidewalls;

a drive means for actuating oscillating movement of said oscillatable elongate blade member, said drive means comprising a pair of cams each being securely mounted to a shaft for rotation therewith and for urging said supports arms forwardly relative to the housing, and a pair of biased elements for biasedly urging said oscillatable elongate blade member rearwardly relative to the housing; and skid means for regulating disposition of said oscillatable elongate blade member relative to a surface.

7. A snowblower chisel attachment as described in claim 6, wherein said cams each have a plurality of lobes for intervally contacting and urging a respective one of said support arms forwardly relative to the housing and for urging said oscillatable elongate blade member also forwardly.

8. A snowblower chisel attachment as described in claim 7, wherein said cams each have three lobes generally equally spaced about its respective said cam.

9. A snowblower chisel attachment as described in claim 8, wherein said lobes are disposed upon said cams to essentially contact said support arms a plurality of intervally distinct times per revolution of said cams.

10. A snowblower chisel attachment as described in claim 7, wherein said pair of biased elements are connected to said oscillatable elongate blade member for urging said oscillatable elongate blade member rearwardly between when said lobes intervally contact said support arms and for effecting oscillation of said oscillatable elongate blade member in cooperation with said lobes.

* * * * *